US005078114A

United States Patent [19]

Haag et al.

[11] Patent Number: 5,078,114

[45] Date of Patent: Jan. 7, 1992

[54] ELECTRICALLY CONTROLLED FUEL INJECTION PUMP

[75] Inventors: Gottlob Haag, Markgroeningen; Ernst Linder, Muehlacker; Helmut Rembold, Stuttgart, all of Fed. Rep. of Germany

[73] Assignee: Robert Bosch GmbH, Stuttgart, Fed. Rep. of Germany

[21] Appl. No.: 444,241

[22] Filed: Dec. 1, 1989

[30] Foreign Application Priority Data

Dec. 30, 1988 [DE] Fed. Rep. of Germany ..... 3844363

[51] Int. Cl.[5] ..... F02M 41/00

[52] U.S. Cl. ..... 123/450; 123/506; 123/179.17

[58] Field of Search ..... 123/179 L, 450, 299, 123/300, 506

[56] References Cited

U.S. PATENT DOCUMENTS

| | | | |
|---|---|---|---|
| 4,083,345 | 4/1978 | Davis | 123/179 L |
| 4,310,291 | 1/1982 | Green | 123/179 L |
| 4,530,324 | 7/1985 | Tanaka | 123/450 |
| 4,531,491 | 7/1985 | Iyama | 123/450 |
| 4,554,901 | 11/1985 | Gibson | 123/450 |
| 4,564,341 | 1/1986 | Tanaka | 123/450 |
| 4,709,673 | 12/1987 | Babitzka | 123/450 |
| 4,751,903 | 6/1988 | Pruneda | 123/450 |
| 4,879,984 | 11/1989 | Rembold | 123/450 |
| 4,896,645 | 1/1990 | Potter | 123/450 |
| 4,951,626 | 8/1990 | Haag | 123/450 |

*Primary Examiner*—Carl Stuart Miller

*Attorney, Agent, or Firm*—Edwin E. Greigg; Ronald E. Greigg

[57] ABSTRACT

An electrically controlled fuel injection pump for internal combustion engines, in particular for direct fuel injection in engines having externally supplied ignition. A plurality of pump pistons driven by drive cams at a constant stroke and each leading into one cylinder bore, pump the fuel that has been brought to injection pressure in an associated pump work chamber to injection valves. A plurality of pump pistons are positioned side by side, radially of the camshaft. The work chambers of the pump pistons are connectable via a rotary slide valve to lines which lead to the injection valves and optionally to supply lines for supplying fuel to the work chambers of the pump pistons and the rotary slide can be driven in synchronism with the camshaft.

28 Claims, 7 Drawing Sheets

ELECTRICALLY CONTROLLED FUEL INJECTION PUMP

BACKGROUND OF THE INVENTION

The invention relates to an electrically controlled fuel injection pump for internal combustion engines, especially for direct fuel injection in engines having externally supplied ignition, in which a plurality of pump pistons, driven at a constant stroke by drive cams and each guided in one cylinder bore, pump the fuel, brought to injection pressure in an associated pump work chamber, to injection valves.

A fuel injection pump of this type is found for instance in U.S. Pat. No. 4,459,963 to Straubel et al. In this known fuel injection pump, two side-by-side pump pistons are provided in one fuel injection pump housing, the pump pistons each being driven by a separate camshaft. Each pump pistons pump into a single fuel injection line associated with it and leading to a fuel injection valve of the associated engine. Control of the injection quantity is effected via a common overflow conduit, which can be opened to a relief space with a magnetic valve. The pump pistons also execute their supply strokes in alternation, and to prevent the quantity of fuel pumped by one pump piston at high pressure from being capable of flowing out to the relief side during the intake or fill stroke of the other pump piston, a slide valve control is provided. The pump piston itself, with a control edge, acts as the valve slide. Alternatively, check valves are also provided, in the fuel fill line to the various pump work chambers, among other locations. Thus the known fuel injection pump is embodied as an in-line injection pump, with each pump piston serving to supply fuel to one injection location.

In accordance with an earlier proposal, not yet published (German Patent Application P 38 04 025.8), a fuel supply system to a plurality of injection valves was created in which a plurality of pump pistons can cooperate simultaneously, to attain a high injection pressure for an injection valve or injection location. The smaller structure of this earlier proposal resulted from the fact that a plurality of pump pistons could be driven by a common cam, and that the valve control already provided in principle in U.S. Pat. No. 4,459,963 was replaced by the substantially simpler control using a rotary slide valve. A desired injection pressure could be built up in the central guide of such a rotary slide valve, and depending on the rotational position of the rotary slide valve, injection valves were acted upon by the pump pressure until such time as a suitable diversion took place, for instance by the opening of a magnetic valve to a relief chamber. In this known construction, variously long lines led to the various connections of the rotary slide valve, beginning at the work chambers of the pump pistons, and especially at higher rpm and higher injection pressures, produced conditions that could not be precisely defined.

OBJECT AND SUMMARY OF THE INVENTION

It is the object of the invention to improve an apparatus of the type described above such that for each injection event the same pressure and volume conditions prevail1as much as possible, so that even at high rpm and high injection pressures, precisely replicable values for the course of injection can be obtained. To attain this object, the embodiment according to the invention is essentially defined in that a plurality of pump pistons are connected to the drive cams side by side, radially to the camshaft; that the work chambers of the pump pistons are connectable via a rotary slide valve to lines leading to the injection valve and optionally to supply lines for supplying fuel to the work chambers of the pump pistons; and that the rotary slide is drivable in synchronism with the camshaft. Because a plurality of pump pistons are connected to the drive cams side by side radially to the camshaft, these pistons can be disposed in such a way that their various line or conduit lengths to the various connections of the rotary slide valve can be kept as nearly the same as possible, and even shortened, as a result of which the possible idle volumes are reduced. In this connection it suffices to dispose the camshaft axis substantially parallel to the axis of the rotary slide, and to dispose the pump pistons transversely to the camshaft axis and to the axis of the rotary slide, between the camshaft and the rotary slide, in a pump housing. With this kind of arrangement, the synchronous drive of the rotary slide valve and camshaft is also attainable in a particularly simple manner, for instance via gear wheels meshing with one another. Because a selection can now also be made cyclically via the rotary slide valve for the supply lines supplying fuel to the work chambers of the pump pistons, there is greater replicability for the filling of the work chambers of the pump pistons as well, because once again the line lengths can be kept lately constant for all the pump pistons. Moreover, by using the rotary slide valve for the cyclical closure and connection of the supply lines to the work chambers of the pump pistons, it becomes possible to design the pressure buildup in a central bore of the rotary slide valve substantially identically for each injection event; upon diversion, for instance using the known magnetic valve that effects communication between this pressure chamber or the central bore of the rotary slide valve and a return line or relief chamber, only the pressure built up by one pump piston at a time needs to be reduced again, interrupting the injection event. Simultaneously disposing a plurality of pump pistons side by side makes it possible to limit the required rotational speed of the camshaft to an amount that prevents dynamic distortion in the course of injection. A particularly simple construction is attained if the embodiment is such that the axes of the pump pistons pass orthogonally through the rotary slide. In this way, the various line lengths can also be relatively easily made to be the same length, and the design can be embodied in a simple way such that the control bores of the rotary slide and/or the connecting conduits to the work chambers of the pump pistons are disposed obliquely to the axis of the rotary slide, making the length of the conduits from the work chambers of the pump pistons to the injection valves via the rotary slide substantially equal for all the pump pistons among one another to the associated injection valves. Oblique connecting conduits to the work chambers of the pump pistons of this kind, and/or oblique control bores of the rotary slide, enable equalization of the effective line lengths between th applicable work chamber of the pump piston and the injection valve.

A particularly short connection between the applicable work chamber of the pump piston and the rotary slide valve is obtainable in the aforementioned embodiment by providing that the axes of the pump pistons pass orthogonally through the rotary slide. For especially short connecting conduits, the embodiment is advantageously such that control grooves or bores of the rotary slide to the injection lines and optionally to the supply lines each discharge inside the interior cross section of the work chamber of the pump piston via connecting conduits extending radially to the rotary slide.

Deviating from the embodiment of the earlier proposal according to German Patent Application P 38 04 025, it may be advantageous in the context of the construction according to the invention to provide that magnetic valves are incorporated into the supply lines and are simultaneously used for high-pressure control. The result is greater functional reliability and safety. If a magnetic valve seizes in the closed state, no fuel can be aspirated. Conversely, no pressure buildup is possible. An emergency operation function then exists via the other circuits. Maximum functional reliability and safety naturally results if the rotary slide itself is used as a control valve for the supply of fuel, as an equivalent to the aforementioned preferred provision. In such an embodiment, however, the injection quantity can be varied only by shutting off the built-up pressure. Conversely, the embodiment using the rotary slide itself to control the inflow into the work chamber of the pump pistons has the advantage that the likelihood of malfunction, which is especially high if the magnetic valves in the supply line are fouled, is greatly reduced.

The use of a rotary slide of the type referred to above makes it simple to adapt the course of injection to prevailing conditions by selecting the size and disposition of the control bores of the control slide. In particular, with such a rotary slide, it is readily possible to perform a pre-injection if necessary as well, to which end the embodiment is advantageously such that connected to an axial conduit of the rotary slide, which discharges into control bores or grooves distributed over the circumference of the rotary slide and cooperating with the lines leading to the work chambers and with the injection valves, and that can be acted upon by the pump pressure of the pump pistons, is at least one further control bore or groove, which communicates with a pressure reservoir. In such an embodiment, pumping into the pressure reservoir is then possible in principle whenever no injection event is taking place; in this way, the avoidance of pressure peaks in the control slide and in the connecting lines or conduits between the work chambers of the pump pistons and the high-pressure conduits in the control slide can be assured. However, the pressure reservoir can also be readily used for performing a pre-injection in a cylinder, if a main injection is not simultaneously occurring in that cylinder. To this end, the embodiment advantageously provides that the rotary slide has a connecting bore or groove on its jacket that is separate from the axial conduit of the rotary slide, via which bore or groove each injection valve is connectable separately with the pressure reservoir in a rotational position different from the rotational position in which the axial conduit communicates with the injection valve.

To enable suppressing a pre-injection as desired in a simple manner, this embodiment can be improved by making the pressure reservoir communicate via a magnetic valve with the connecting bore or groove on the jacket of the rotary slide, so that in the unloaded position, this valve blocks the communication between the pressure reservoir and the rotary slide, and preferably by providing that the pressure reservoir communicates with the axial conduit of the rotary slide via a check valve closing toward the pressure reservoir, thus preventing the pressure reservoir from losing pressure when the magnetic valve is opened to shut off an injection event.

To perform a charging of the pressure reservoir outside the pumping range provided for a main injection and to reliably avoid any influence of any pressure fluctuations arising in the charging of the reservoir during the injection, the embodiment is advantageously such that in a rotary position different from the rotary position in which the pressure reservoir and/or the axial conduit communicates with an injection valve, the pressure reservoir can be acted upon by the pump pressure of the pump pistons, via the control bore or groove of the rotary slide.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
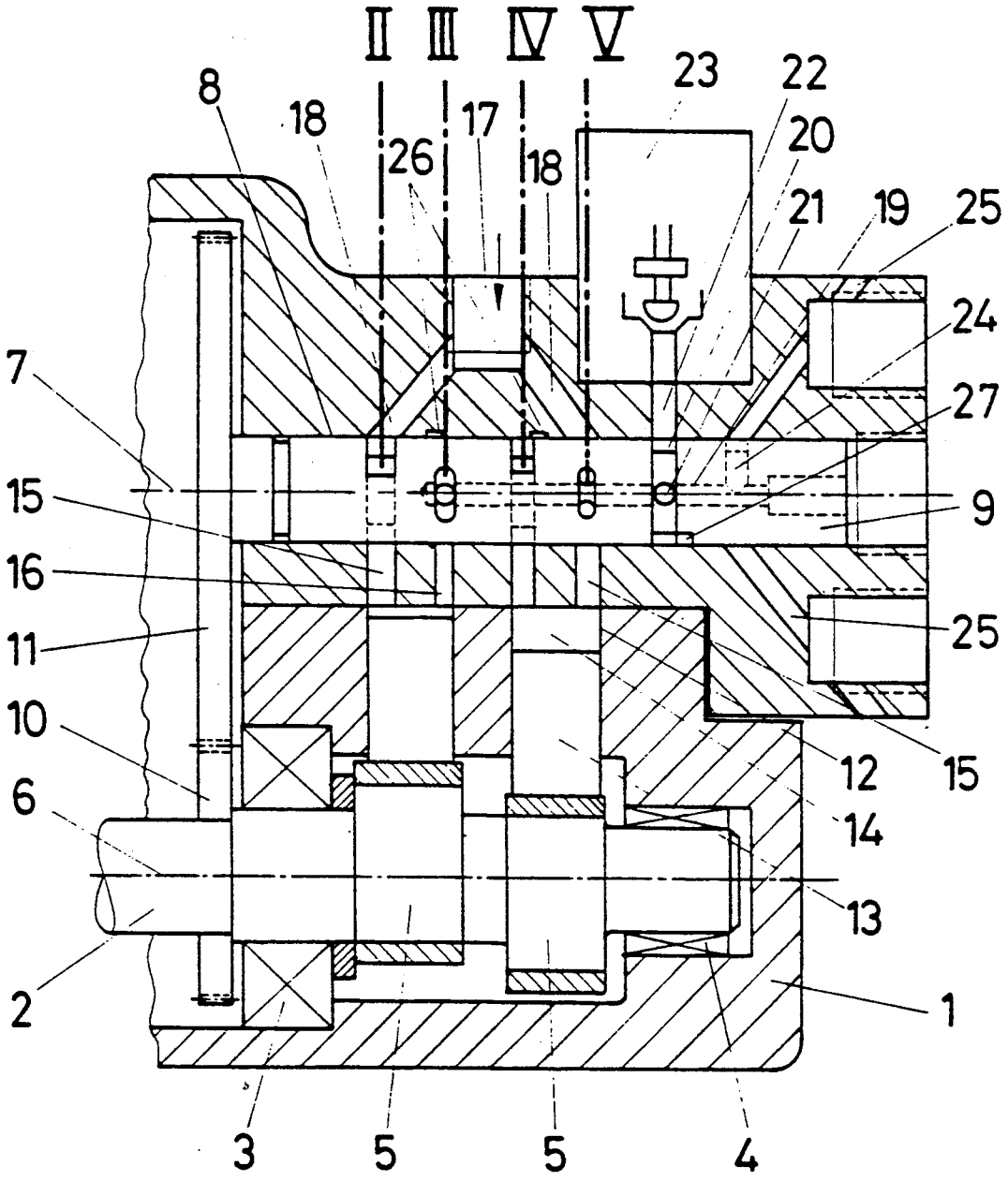
FIG. 1 is a section through a first exemplary embodiment of the fuel injection pump according to the invention.

In FIG. 1, a pump housing 1 of a distributor fuel injection pump is shown, in which a drive shaft 2 entering the housing from the outside is supported via bearings 3 and 4, and the drive shaft has drive cams 5. These cams 5 have a circular path as their cam path, for instance located eccentrically with respect to the axis 6 of the driveshaft 2, and on this path a roller or needle bearing is for instance disposed, although this is not shown for the sake of simplicity. A rotary slide valve 9 acting as a distributor is also guided in the pump housing 1 in a guide bore 8, about an axis 7 parallel to the axis 6 of the drive shaft 2. A drive of the rotary slide valve 9 in synchronism with the rotational motion of the driveshaft 2 is effected via gear wheels 10 and 11 on one face end of the pump housing 1.

From the camshaft or drive shaft 2, via the cams 5, pump pistons 13 guided in cylinder bores 12 of the pump housing are acted upon, and in the view of FIG. 1 two pulp pistons 13 located side by side are connected radially to the camshaft or driveshaft 2. The pump pistons 13 each define work chambers 14, into each of which one supply line 15 for fuel at pre-pump pressure and one pressure line 16 discharge inside the interior cross section of the work chambers 14 of the pump pistons 13 in a direction substantially radially to the rotary slide valve 9. The supply of fuel to the work chambers 14 of the pump pistons is effected via a common inlet 17 or via conduits 18 leading to the rotary slide 9; the fuel then flows at pre-pump pressure, via control bores or grooves provided in the rotary slide valve 9, into the supply lines 15 to reach the work chambers 14. The disposition of control bores in the rotary slide valve 9 is shown in further detail in FIGS. 2 and 5.

After compression of fuel in the work chambers 14, the fuel flows via the lines 16 and control bores or grooves suitably disposed in the rotary slide valve into a conduit 19 extending substantially in the axial direction of the distributor shaft or of the rotary slide 9, and connected to this conduit in addition to the aforementioned control bores or grooves, which with reference to FIGS. 2–5 will be described in further detail below, is at least one further control bore 21 discharging into a control groove 20; the control bore 21 communicates via a connecting line 22 with a magnetic valve 23. Also connected to the axial conduit 19 of the rotary slide valve 9 is a further control bore 24, which in various rotational positions of the rotary slide 9 communicates with one supply line 25 at a time leading to injection valves not shown in detail. Depending on the rotary position of the rotary slide valve 9, the supply lines or pressure lines 25 to the various injection valves are supplied with fuel at injection pressure in suitable pump piston supply strokes. The duration of the injection is determined by the electrically controlled magnetic valve 23, which being triggered by a corresponding control circuit, not shown in detail, upon the closure of the relief line 22 with alignment of the control bore 24 with one supply line 25, initiates the injection onset of an injection valve, and with the opening of the relief line 22 determines the end of injection. Thus at the same time both the injection quantity and the phase relationship of the injection are determined.

Pressure equalization pockets 26 are suggested on the cylindrical face of the guide bore 8 of the rotary slide valve 9, provided in the vicinity of the pressure lines 16 connecting the work chambers 14 of the pump pistons with the rotary slide valve 9. A similar pressure equalization pocket 27 is provided on the jacket of the rotary slide 9 in the vicinity of the control groove 20, which communicates with the magnetic valve 23.

The rpm of the rotary slide valve 9 relative to the rpm of the drive shaft or camshaft 2 is selected in accordance with the number of pump pistons 13 cooperating with the drive shaft 2 and with the number of injection valves to be supplied.

Figure 2:
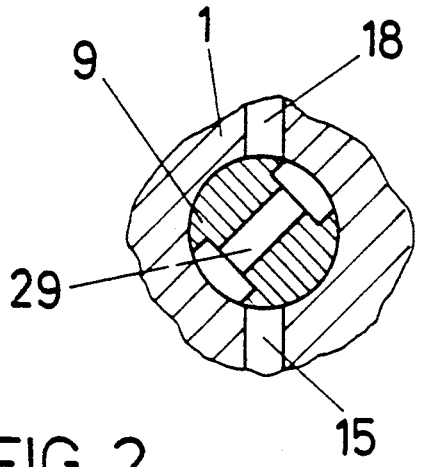
FIGS. 2-5 are section taken along the lines II—II, III—III, IV—IV and V—V, respectively, through various cross-sectional planes of the rotary slide valve of FIG. 1.
Figure 3:
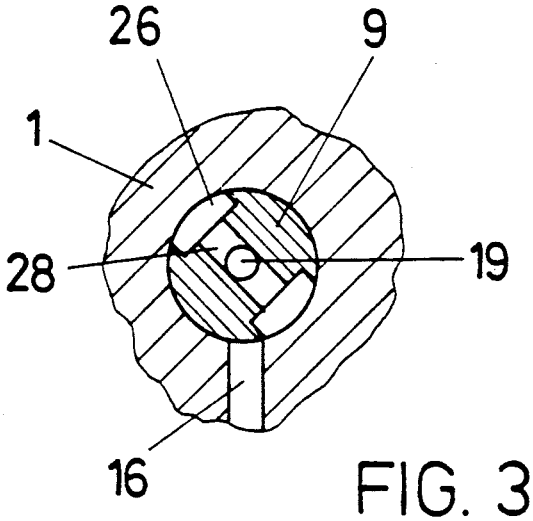
Figure 4:
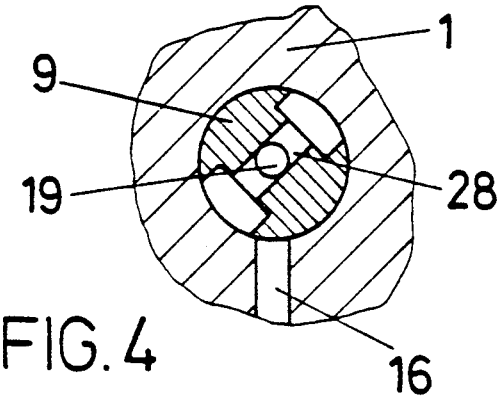
Figure 5:
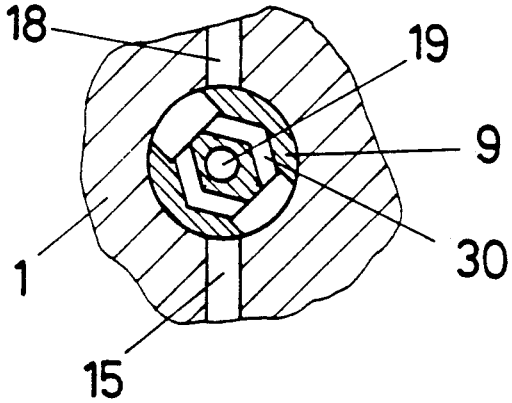

In FIGS. 2–5, the control bores or grooves of the rotary slide 9 are shown in detail in the planes of the supply lines 15 or high-pressure lines 16 between the rotary slide 9 and the various pump work chambers 14. Once again the supply lines to the rotary slide 9 are identified by reference numeral 18, and the connecting lines between the rotary slide 9 and the various work chambers for the supply of fuel are identified by reference numeral 15. Once again, the pressure lines are identified by reference numeral 16. As can be seen in FIGS. 3 and 4, the control bores or grooves 28 cooperating with the high-pressure lines 16 are embodied substantially identically and each discharges into the axial conduit 19 of the rotary slide 9. The control bore that cooperates with the supply line 15 of a first cylinder, provided in the vicinity of the rotary slide 9 in which there is as yet no axial conduit 19, may likewise be embodied as a simple bore 29 passing through the rotary slide 9, as clearly shown in FIG. 2. As shown in FIG. 5, the supply control bore 30 for the work chamber or chambers 14, which discharge in a region of the rotary slide 9 in which the axial conduit must be provided anyway, contrarily must be disposed in such a way as not to enable any communication between the supply lines 18 or 15 and the axial conduit 19.

In the rotary position of the rotary slide 9 shown in FIG. 2, the associated pump piston 13 is at top dead center; upon further rotation the communication between the supply line 18 and the work chamber 14 is effected via the control bore 29 and the supply line 15. In the intake phase shown in FIG. 3, the pressure bore 16 is closed by the rotary slide 9. In the ensuing supply stroke, the communication with the axial conduit is then enabled via the control bore 28 and the rotary slide 9. The pressure equalization pocket 26, which in terms of surface area is precisely equivalent to the supply bore 15, is located opposite the pressure line or pressure bore 16. During the pumping or compression stroke, this pressure equalization pocket 26 is acted upon, via the pressure line 16 and the control bore 28, with the same pressure as the supply bore 15, which at that moment is closed. The resultant lateral forces cancel one another out in this case, and the tilting moment that still exists is negligible. In FIG. 4, the view is similar to FIG. 3, again through a cross-sectional plane connecting the pressure line 16 with the rotary slide 9; in this case, the rotary slide or the distributor shaft is offset by 90°, because the corresponding pump piston is at bottom dead center. The function according to FIG. 5 is again equivalent to that of FIG. 2, with a correspondingly rotated rotary slide 9. For the sake of completeness, it is noted that in the view of FIG. 1, the distributor shaft is shown rotated by 45° for the sake of greater clarity.

Figure 6:
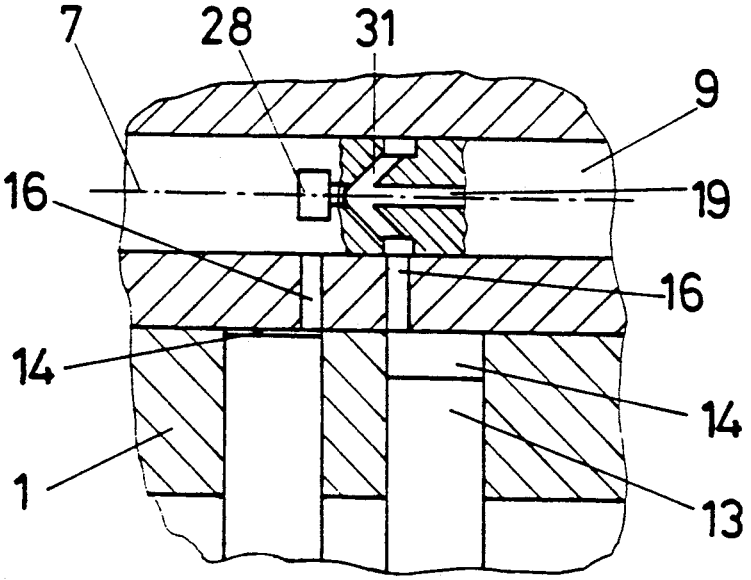
FIG. 6 is a fragmentary view similar to FIG. through a modified embodiment of the rotary slide.

In FIG. 6, a special embodiment of the control bores that cooperate with the pressure lines 16 from the work chambers 14 of the pump pistons 13 is shown. To even out the length of the conduits from the work chambers 14 to the injection valves, the control bore 28 that is farther from the supply lines to the injection valves and cooperates with a cylinder is shown similarly to the view in FIGS. 1 and 3, while the control bore located closer to the supply lines leading to the injection valves is embodied as a control bore 31 extending obliquely to the axis 7 and to the axial conduit 19 of the rotary slide 9. As a result, the bore length, i.e. the length of the supply lines to the injection nozzles, is absolutely equal, which makes calibrating the entire injection system easier. Instead of oblique control bores in the rotary slide 9, the pressure bores or pressure lines 16 could naturally be obliquely positioned in the pump housing 1 and could cooperate with substantially radial control bores in the rotary slide 9.

Figure 7:
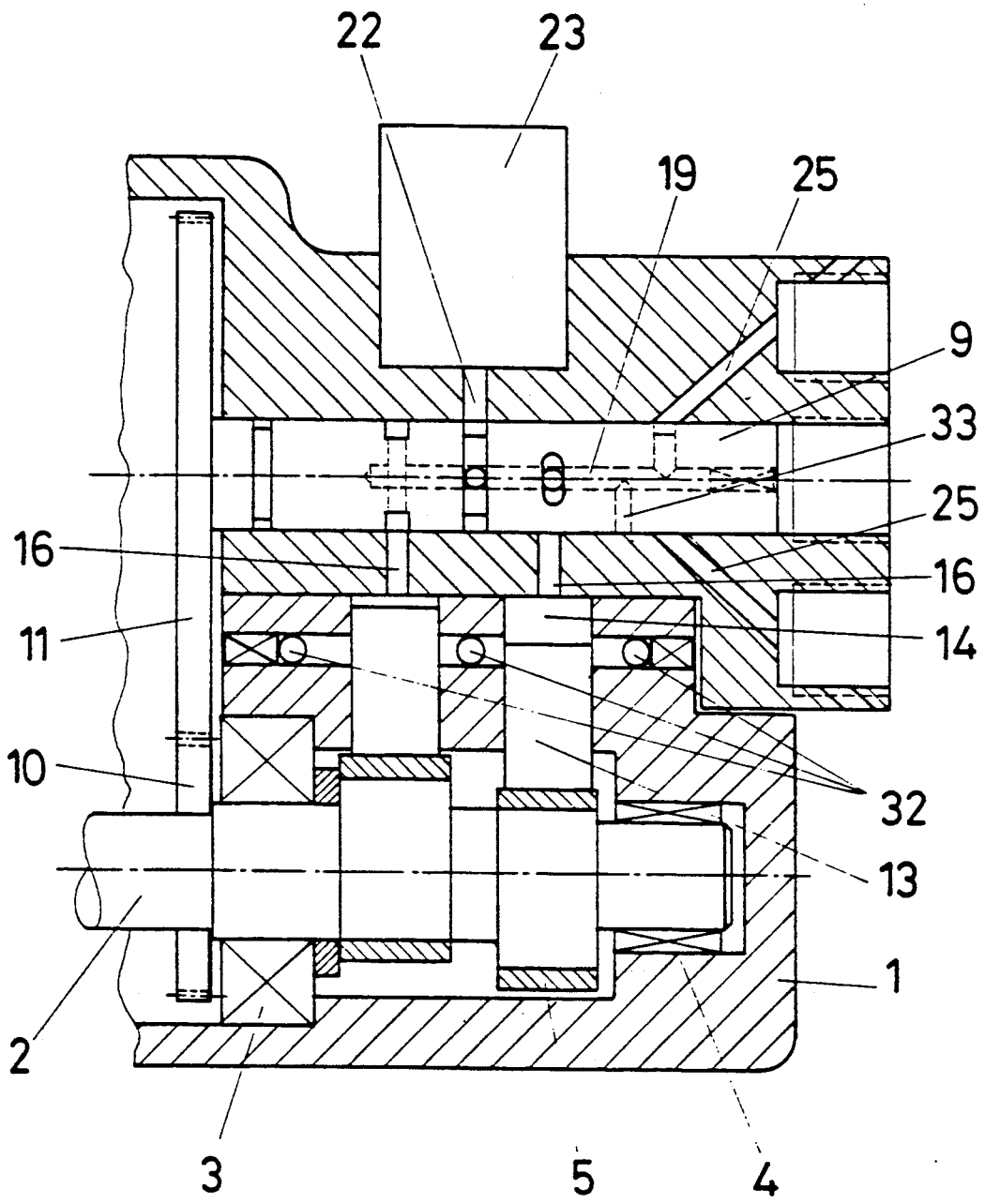
FIG. 7 shows a further variant of the fuel injection pump according to the invention in a view similar to FIG. 1, in which the supply of fuel to the work chambers of the pump pistons takes place via an intake slit control.

In the embodiment of FIG. 7, for identical components, the reference numerals of FIG. 1 are retained. Once again there is a plurality of pump pistons 13 side by side, driven by a camshaft or drive shaft 2 via cams 5 and having work chambers 14, and once again the corresponding pressure lines 16 discharge via control bores or control grooves into the axial conduit 19 of the rotary slide valve 9, by way of which fuel is again supplied to pressure lines 25 and injection locations or valves not shown in further detail. The control of the events of injection is similar to the embodiment of FIG. 1, via the electrically actuatable magnetic valve 23.

Differing from the embodiment of FIG. 1, the delivery of fuel at pre-pump pressure to the work chambers 14 of the various pump pistons 13 is effected in the embodiment of FIG. 7 not via control bores or grooves in the rotary slide 9 but rather via an intake slit control; the aspiration takes place via an inlet, embodied by a conduit 32 in the pump housing, in each case at bottom dead center of the pump piston. Thus only the control bores or grooves for the high-pressure circuit are provided in the rotary slide 9 and communicate with one another via the axial conduit 19. A pressure equalization bore for the distributor bore in FIG. 7 is also identified by reference numeral 33. The rotary slide valve or distributor shaft 9 is also shown rotated by 45° in FIG. 7 for the sake of simplicity.

Figure 8:
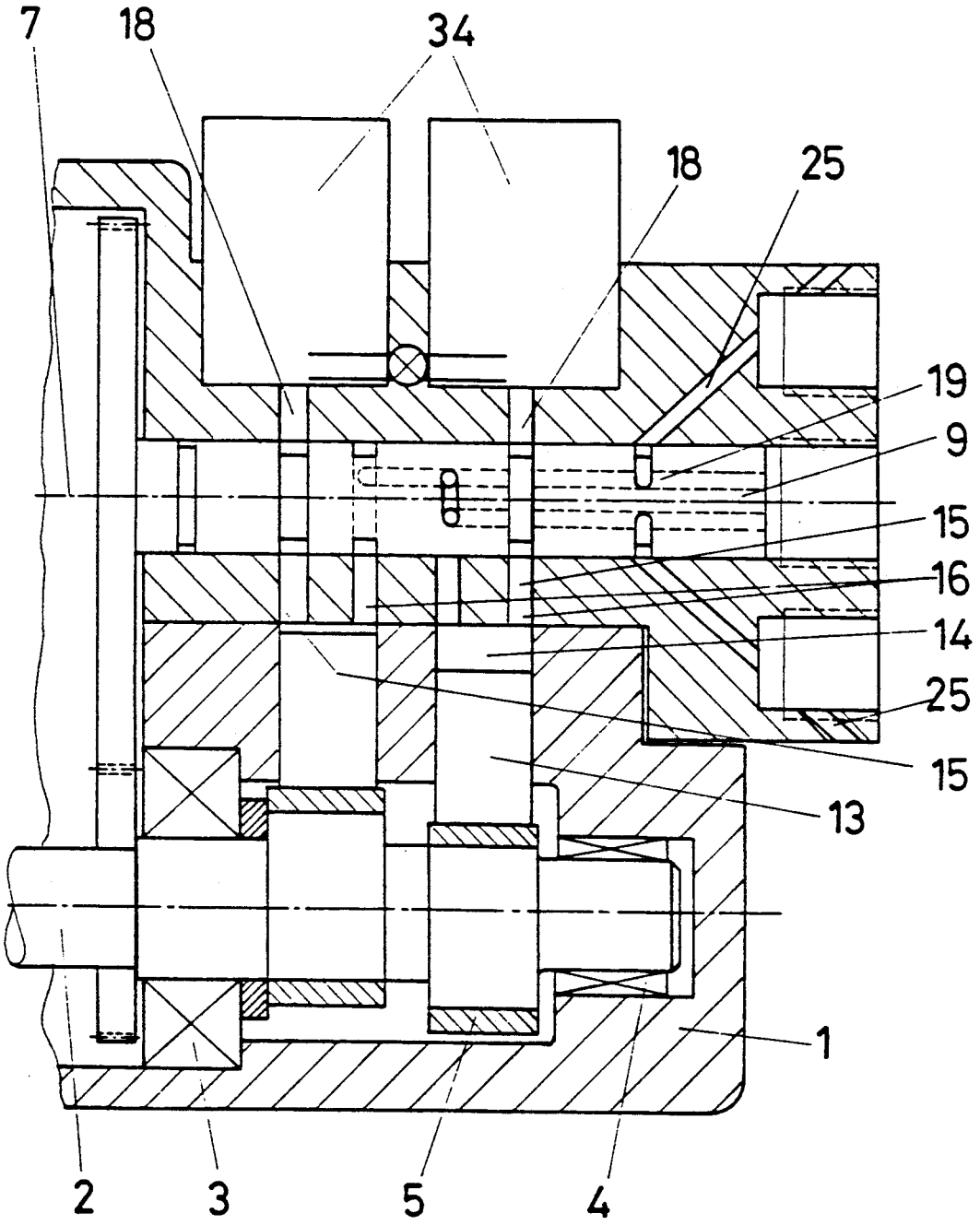
FIG. 8 shows a variant of the fuel injection pump according to the invention in which magnetic valves are incorporated into the supply lines to the work chambers of the pump pistons.

In the view of FIG. 8, once again the reference numerals of FIGS. 1 and 7 are retained for identical components. In this embodiment, the delivery of fuel at pre-pump pressure takes place similarly to the embodiment of FIG. 1 via the rotary slide 9, and one magnetic valve 34 is incorporated into each of the supply lines 18. The pressure lines 16 from the work chambers 14 again discharge into the conduit 19 extending in the axial direction of the rotary slide valve, but in this embodiment the conduit 19 is disposed not substantially centrally but rather parallel to the axis 7. In order to clearly show this provision, the half of the distributor shaft oriented toward the pistons 13 is shown rotated by 45°, in order to show the variable position of the axial conduit 19 relative to the axis 7 in various rotational positions of the rotary slide 9. Not only the high-pressure control but the filling of the work chambers 14 as well is now effected via the magnetic valve. The groove in the distributor shaft adjoining the bore 15 is therefore continuous. In this case the magnetic valve can also be connected directly to the chamber 14. The advantage of disposing magnetic valves 34 in the supply lines 18 is that if one magnetic valve should fail, emergency operation can be maintained via the intact circuit.

Figure 9:
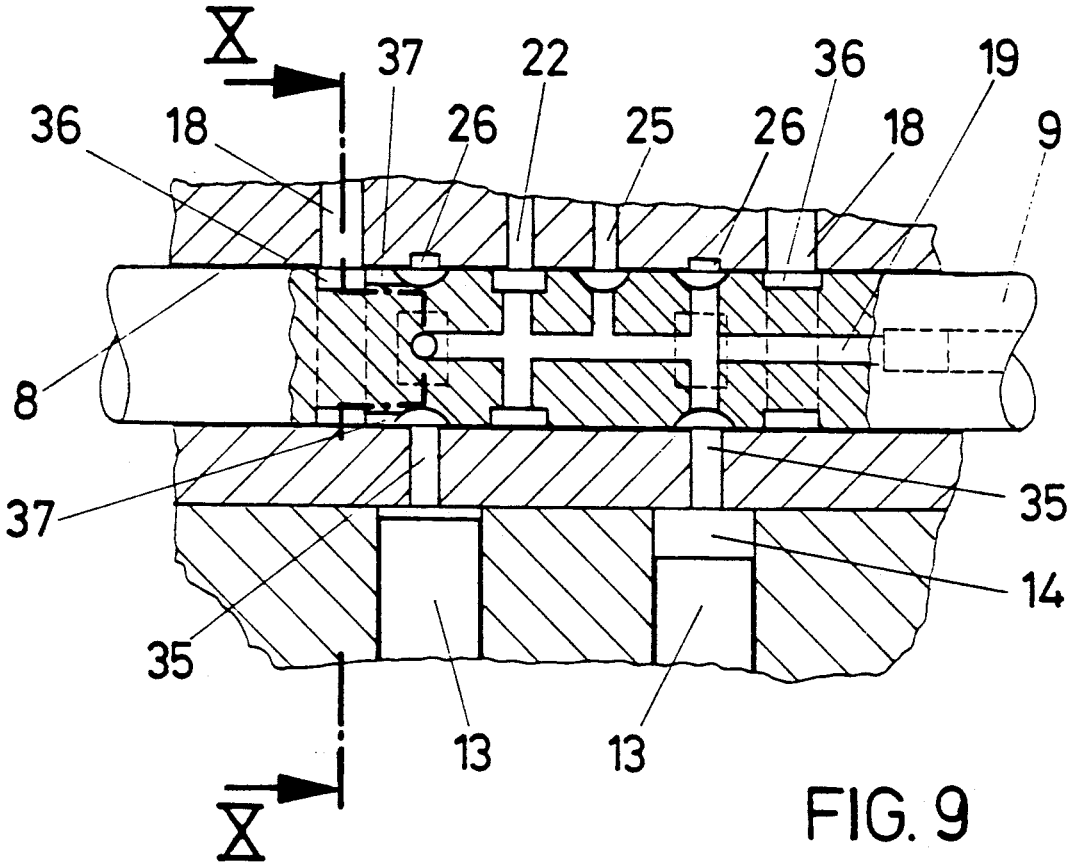
FIG. 9 shows a modified embodiment of the rotary slide, in which the same lines are used for supplying the fuel to the work chambers of the pump piston and for diverting the pressurized fuel to the rotary slide.
Figure 10:
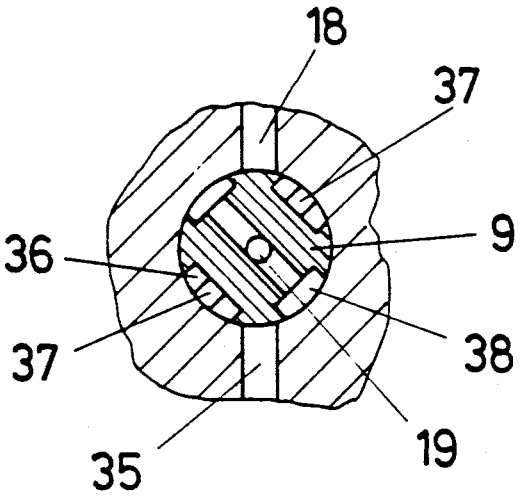
FIG. 10 is a section taken along the line X—X of FIG. through various cross-sectional planes of the rotary slide.

In FIG. 9, similarly to the view of FIG. 6, once again only a section through the rotary slide valve 9 is shown. In this embodiment, the supply lines 18 are once again the fuel supply lines for supplying fuel at pre-pump pressure, and as in the embodiment of FIG. 1 the line 22 communicates with the magnetic valve for controlling the injection events, and via the lines 25 communication with the various injection valves is established in the various rotational positions of the rotary slide valve 9. The communication of the control bores or grooves in the rotary slide valve 9 that are at high pressure is again effected via the axial conduit 19. Similarly to the embodiment of FIG. 1, both the delivery of fuel at pre-pump pressure into the rotary slide valve 9 and the feeding of fuel at high pressure via the rotary slide valve 9 again takes place via the rotary slide valve 9, and in the embodiment shown in FIG. 9 there is only one connecting line 35 provided between the work chambers 14 of the pump pistons 13 and the rotary slide valve 9. In various rotational positions of the rotary slide valve, the line 35 is acted upon by fuel both at low pressure and at high pressure in the pumping stroke; the delivery of fuel takes place via the supply line 18 into a control recess 36, provided on the circumference of the rotary slide valve 9, which in various rotational positions via a conduit 37 extending axially along the jacket face assures a communication of the control recess 36 with the supply line 35 to the work chamber 14. By comparison, at angular positions of the rotary slide valve that correspond to pumping strokes of the pump pistons 13, the communication between the supply line 8 via the control grooves or conduits 36 and 37 and the line 35 is interrupted, and as in the preceding embodiments the feeding of fuel at high pressure takes place via a control bore 38 into the axial conduit 19, as can clearly be seen in FIG. 10. Once again pressure equalization pockets 26 area provided opposite the connecting line 35 on the cylindrical face of the guide bore 8 of the rotary slide valve 9. Because the same line 35 is used both for delivering fuel to the work chambers 14 and for diverting the fuel at high pressure, this embodiment has fewer idle spaces, and the distributor shaft or rotary slide valve 9 can be embodied more simply overall.

Figure 11:
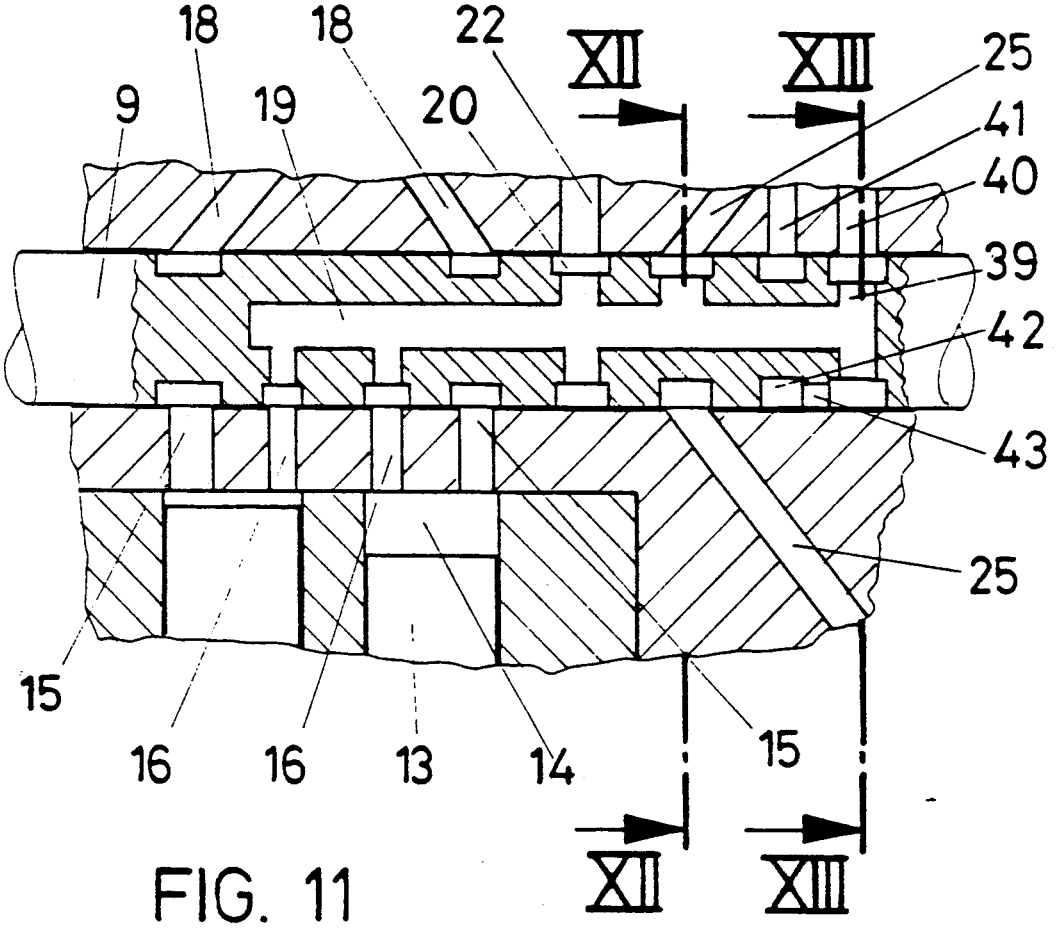
FIG. 11 shows a further embodiment of the rotary slide of a fuel injection pump according to the invention, which additionally has control bores or control grooves for communication with a pressure reservoir.

In FIG. 11, a further embodiment of a rotary slide valve 9 is shown, which in addition to having a structure substantially similar to the rotary slide valve of FIG. 1 allows a pressure reservoir to be attached. Similarly to FIG. 1, both the delivery of fuel via the supply lines 18 and the introduction of fuel at high pressure are effected via or into the rotary slide valve 9. The control of the injection events into the pressure lines 25 to injection valves not shown further is again effected via a magnetic valve connected to the line 22, which communicates with the axial conduit. The axial conduit 19 which is at pump pressure of the pump pistons 13 has not only the control bores or grooves or communication with the work chambers 14 or injection lines 25 and the magnetic valve, but also control bores 39 for control in a further radial plane; these bores communicate with a line 40 to a pressure reservoir, shown in further detail in FIGS. 14 and 15. Also adjoining the rotary slide valve 9 is a line 41, carrying fuel from the aforementioned pressure reservoir at reservoir pressure to the rotary slide valve 9; this line discharges into an annular groove 42 provided on the circumference of the rotary slide valve. This annular groove communicates with a conduit 43 extending in the axial direction of the rotary slide valve 9 and in an appropriate rotary position of the rotary slide valve 9 enables communication with an injection line 25 to an injection valve that in that rotary position does not communicate with the axial conduit 19. As a result not only a main injection, which is effected by pumping fuel from the axial conduit 19 into an injection line 25, but a pre-injection can also be performed at top dead center of the load change into a further injection valve.

Figure 12:
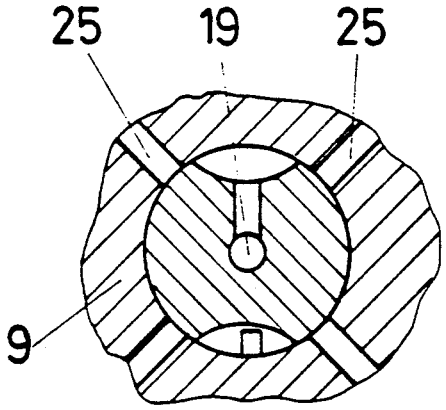
FIGS. 12 and 13 are sections taken along the lines XII—XII and XIII—XIII, respectively, of FIG. 11 through various cross-sectional planes of the rotary slide.
Figure 13:
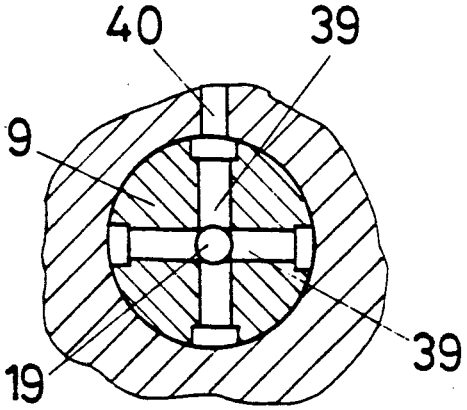

From the illustration in FIGS. 12 and 13, it is clear that the process of charging the reservoir piston takes place in each case only outside the primary pumping range of the pump pistons, or in other words outside the main injection effected into an injection valve. The control bores to the injection lines 25 or to the line 40 to the pressure reservoir, or the lines in the pump housing itself, are correspondingly offset relative to one another.

Figure 14:
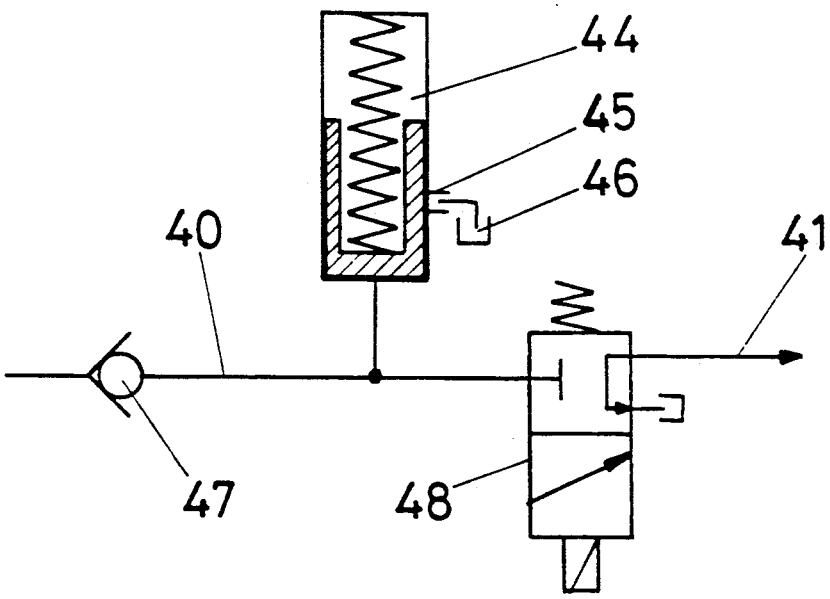
FIGS. 14 and 15 show two exemplary embodiments of a pressure reservoir for a fuel injection pump in accordance with FIG. 11.

In FIG. 14, a first version of a pressure reservoir in the form of a spring reservoir 44 is shown. The spring reservoir 44 is supplied with fuel under pressure via the line 40; to prevent overloading of the reservoir, a diversion bore 45 is provided, which discharges into a return line or tank 46. In order to reliably prevent feedback of the pressure conditions prevailing under some circumstances in the high-pressure circuit of the rotary slide valve 9 from affecting the reservoir pressure in the spring reservoir 44 or to prevent a return flow of fuel at high pressure via the line 40 into the rotary slide 9, a check valve 47 is provided in the line 40. To initiate a pre-injection, a magnetic valve 48 of three/two-way structure is incorporated into the line 41 leading from the reservoir 44 to the rotary slide 9. With the provision of such a magnetic valve 48, the injection process of the pre-injection can be correspondingly controlled.

Figure 15:
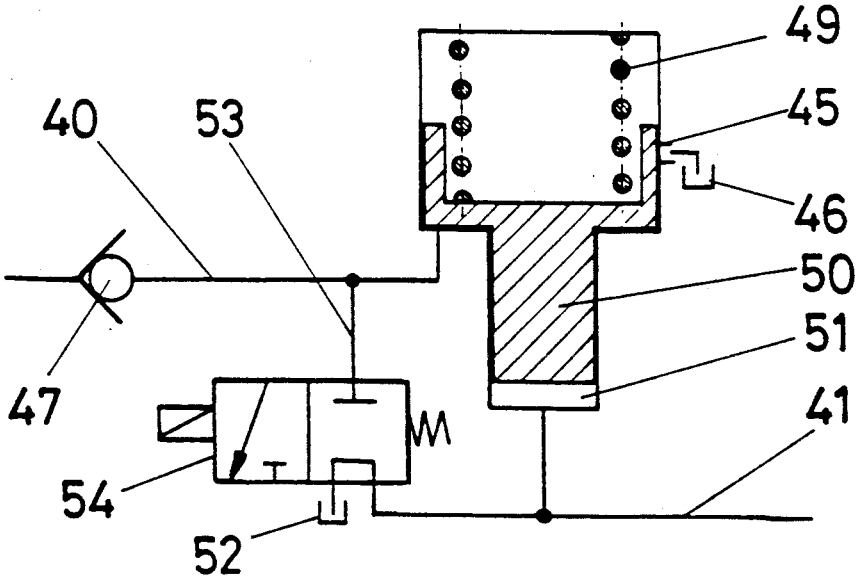

In FIG. 15, a stepped piston 50 acted upon by a spring 49 is used as the pressure reservoir, and this piston can be acted upon in turn, via the line 40, with fuel at pumping pressure. When the stepped piston 50 is acted upon, fuel is aspirated into both a further work chamber 51 and the line 41. Tripping of the pre-injection of the fuel contained in the separate work chamber 51 is effected by switching over the magnetic valve 54 incorporated into a branch line 53 of the line 40, so that a pre-injection takes place via the line 41 by means of the reciprocating motion of the stepped piston 50 caused by the prestressed spring 49. The pre-injection is effected either by the terminal position shown in FIG. 15 of the stepped piston 50 or by actuating the magnetic valve 54 again, as a result of which the separate work chamber 51 or the line 41 communicates with the return line 52. A check valve 47 provided in the line 40 prevents feedback upon the high-pressure conditions prevailing in the rotary slide valve 9 during the relief of the stepped piston 50 via the branch line 52.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An electrically controlled fuel injection pump for internal combustion engines, in particular for direct fuel injection in engines having externally supplied ignition, comprising a plurality of pump pistons (13) disposed in a pump housing radially of a camshaft and driven by drive cams on said camshaft at a constant stroke, each of said pistons reciprocate in one cylinder bore and is adapted to pump fuel from a work chamber (14) relative to each of said pistons to injection valves, said work chamber (145) of the pump pistons (13) being connectable via flow lines (16) and control openings (28) on a rotary slide valve (9) and a connecting conduit (19) in said rotary slide valve (9) and connecting lines in said rotary slide valve to a control opening on said rotary valve that connects said work chamber in turn to different lines (25) leading to different injection valves, said work chamber of said pistons being further connected via control openings on said rotary slide valve and connection lines therein to supply lines (18) for supplying fuel to the work chambers (14) of the pump pistons (13); and further that the rotary slide (9) is drivable in synchronism with the camshaft (2), a relief line (22) that communicates continuously with said connecting conduit (19), and an electromagnetic valve in said relief line which controls fuel flow through said relief line and which controls a duration and onset of the fuel injection.

2. A fuel injection pump as defined by claim 1, in which the pump pistons (13) include axes which pass orthogonally through the rotary slide (9).

3. A fuel injection pump as defined by claim 1, in which control means (28, 29, 30, 31, 38) of the rotary slide (9) leading to the injection lines (25) and optionally to the supply lines (18) each discharge inside the interior cross section of the work chamber (14) of the pump piston via connecting conduits (15, 16, 35) extending radially to the rotary slide (9).

4. A fuel injection pump as defined by claim 2, in which control means (28, 29, 30, 31, 38) of the rotary slide (9) leading to the injection lines (25) and optionally to the supply lines (18) each discharge inside the interior cross section of the work chamber (14) of the pump piston via connecting conduits (15, 16, 35) extending radially to the rotary slide (9).

5. A fuel injection pump as defined by claim 1, in which the control means (31) of the rotary slide (9) and/or the connecting conduits to the work chambers (14) of the pump pistons (13) are disposed obliquely to the axis (7) of the rotary slide (9) such that the length of the connecting conduits is substantially equal for all the pump pistons relative to the associated injection valves which extend from the work chambers (14) of the pump pistons (13) to the injection valves via the rotary slide (9).

6. A fuel injection pump as defined by claim 2, in which the control means (31) of the rotary slide (9) and/or the connecting conduits to the work chambers (14) of the pump pistons (13) are disposed obliquely to the axis (7) of the rotary slide (9) such that the length of the connecting conduits is substantially equal for all the pump pistons relative to the associated injection valves which extend from the work chambers (14) of the pump pistons (13) to the injection valves via the rotary slide (9).

7. A fuel injection pump as defined by claim 3, in which the control means (31) of the rotary slide (9) and/or the connecting conduits to the work chambers (14) of the pump pistons (13) are disposed obliquely to the axis (7) of the rotary slide (9) such that the length of the connecting conduits is substantially equal for all the pump pistons relative to the associated injection valves which extend from the work chambers (14) of the pump pistons (13) to the injection valves via the rotary slide (9).

8. A fuel injection pump as defined by claim 1, in which magnetic valves (34) are incorporated into the supply lines (18).

9. A fuel injection pump as defined by claim 2, in which magnetic valves (34) are incorporated into the supply lines (18).

10. A fuel injection pump as defined by claim 3, in which magnetic valves (34) are incorporated into the supply lines (18).

11. A fuel injection pump as defined by claim 4, in which magnetic valves (34) are incorporated into the supply lines (18).

12. A fuel injection pump as defined by claim 1, in which at least one further control means (39), which communicates with a pressure reservoir (44, 50), is connected to an axial conduit (19) of the rotary slide (9), which rotary slide discharges into said control means (28, 31, 38), that are distributed over the circumference of the rotary slide and arranged to cooperate with the lines (16, 35) which lead to the work chambers (14) and with the injection valves, and further is capable of being acted upon by the pump pressure of the pump pistons (13).

13. A fuel injection pump as defined by claim 2, in which at least one further control means (39), which communicates with a pressure reservoir (44, 50), is connected to an axial conduit (19) of the rotary slide (9), which rotary slide discharges into said control means (28, 31, 38), that are distributed over the circumference of the rotary slide and arranged to cooperate with the lines (16, 35) which lead to the work chambers (14) and with the injection valves, and further is capable of being acted upon by the pump pressure of the pump pistons (13).

14. A fuel injection pump as defined by claim 3, in which at least one further control means (39), which communicates with a pressure reservoir (44, 50), is connected to an axial conduit (19) of the rotary slide (9), which rotary slide discharges into said control means (28, 31, 38), that are distributed over the circumference of the rotary slide and arranged to cooperate with the lines (16, 35) which lead to the work chambers (14) and with the injection valves, and further is capable of being acted upon by the pump pressure of the pump pistons (13).

15. A fuel injection pump as defined by claim 4, in which at least one further control means (39), which communicates with a pressure reservoir (44, 50), is connected to an axial conduit (19) of the rotary slide (9), which rotary slide discharges into said control means (28, 31, 38), that are distributed over the circumference of the rotary slide and arranged to cooperate with the lines (16, 35) which lead to the work chambers (14) and with the injection valves, and further is capable of being acted upon by the pump pressure of the pump pistons (13).

16. A fuel injection pump as defined by claim 5, in which at least one further control means (39), which communicates with a pressure reservoir (44, 50), is connected to an axial conduit (19) of the rotary slide (9), which rotary slide discharges into said control means (28, 31, 38), that are distributed over the circumference of the rotary slide and arranged to cooperate with the lines (16, 35) which lead to the work chambers (14) and with the injection valves, and further is capable of being acted upon by the pump pressure of the pump pistons (13).

17. A fuel injection pump as defined by claim 12 in which the rotary slide (9) has a connecting means (42, 43) on its jacket that is separate from the axial conduit (19) of the rotary slide, via which connecting means each injection valve is connectable separately with the pressure reservoir (44, 50) in a rotational position different from the rotational position in which the axial conduit (19) communicates with the injection valve.

18. A fuel injection pump as defined by claim 16 in which the pressure reservoir (44, 50) communicates with the axial conduit (19) of the rotary slide (9) via a check valve (47) which is adapted to close toward the pressure reservoir.

19. A fuel injection pump as defined by claim 17, in which the pressure reservoir (44, 50) communicates with the axial conduit (19) of the rotary slide (9) via a check valve (47) which is adapted to close toward the pressure reservoir.

20. A fuel injection pump as defined by claim 16 in which pressure reservoir (44, 50) communicates via a magnetic valve (48, 54) with the connecting means (42, 43) on the jacket of the rotary slide (9), which valve, in the unloaded position, blocks communication between the pressure reservoir (44, 50) and the rotary slide (9).

21. A fuel injection pump as defined by claim 17, in which pressure reservoir (44, 50) communicates via a magnetic valve (48, 54) with the connecting means (42, 43) on the jacket of the rotary slide (9), which valve, in the unloaded position, blocks communication between the pressure reservoir (44, 50) and the rotary slide (9).

22. A fuel injection pump as defined by claim 18, in which pressure reservoir (44, 50) communicates via a magnetic valve (48, 54) with the connecting means (42, 43) on the jacket of the rotary slide (9), which valve, in the unloaded position, blocks communication between the pressure reservoir (44, 50) and the rotary slide (9).

23. A fuel injection pump as defined by claim 12, in which the pressure reservoir communicates within injection valve, via the control means (39) of the rotary slide (9), in a rotary position different from the rotary position in which the pressure reservoir (44, 50) and/or the axial conduit can be acted upon by the pump pressure of the pump pistons (13).

24. A fuel injection pump as defined by claim 17, in which the pressure reservoir communicates with an injection valve, via the control means (39) of the rotary slide (9), in a rotary position different from the rotary position in which the pressure reservoir (44, 50) and/or the axial conduit can be acted upon by the pump pressure of the pump pistons (13).

25. A fuel injection pump as defined by claim 18, in which the pressure reservoir communicates with an injection valve, via the control means (39) of the rotary slide (9), in a rotary position different from the rotary position in which the pressure reservoir (44, 50) and/or the axial conduit can be acted upon by the pump pressure of the pump pistons (13).

26. A fuel injection pump as defined by claim 20 in which the pressure reservoir communicates with an injection valve, via the control means (39) of the rotary slide (9), in a rotary position different from the rotary position in which the pressure reservoir (44, 50) and/or the axial conduit can be acted upon by the pump pressure of the pump pistons (13).

27. A fuel injection valve as defined by claim 1 in which said rotary slide valve 9 is parallel with said camshaft.

28. A fuel injection valve as defined by claim 3 in which said connecting conduits (15, 16, 35) are in said housing.

* * * * *